US008661976B2

(12) United States Patent
Ollivier et al.

(10) Patent No.: US 8,661,976 B2
(45) Date of Patent: Mar. 4, 2014

(54) METHOD FOR CONTROLLING A ROTARY PRESS AND ROTARY PRESS

(75) Inventors: Pascal Ollivier, Verneuil en Halatte (FR); Jean-Valere Holvoet, Nointel (FR); Francois Vidaillac, Frocourt (FR)

(73) Assignee: Goss International Corporation, Durham, NH (US)

( * ) Notice: Subject to any disclaimer, the term of this patent is extended or adjusted under 35 U.S.C. 154(b) by 704 days.

(21) Appl. No.: 12/004,848

(22) Filed: Dec. 21, 2007

(65) Prior Publication Data

US 2008/0148979 A1 Jun. 26, 2008

(30) Foreign Application Priority Data

Dec. 22, 2006 (FR) ..... 06 11319

(51) Int. Cl.
*B41F 1/54* (2006.01)
*B65H 16/00* (2006.01)
*B65H 43/00* (2006.01)

(52) U.S. Cl.
USPC ..... 101/484; 101/219; 101/226; 101/228; 101/212; 226/1; 226/11

(58) Field of Classification Search
USPC ..... 101/219, 226, 212, 484; 10/228; 242/480, 390.6, 421.4, 545.1; 271/9.1
See application file for complete search history.

(56) References Cited

U.S. PATENT DOCUMENTS

| | | | | |
|---|---|---|---|---|
| 3,606,800 | A * | 9/1971 | Treff et al. | 74/405 |
| 4,951,567 | A * | 8/1990 | Rodi et al. | 101/216 |
| 6,289,805 | B1 * | 9/2001 | Douillard et al. | 101/247 |
| 6,499,639 | B2 * | 12/2002 | Cote et al. | 226/42 |
| 6,604,661 | B2 | 8/2003 | Feller et al. | |
| 6,899,027 | B2 * | 5/2005 | Kersch | 101/228 |
| 2001/0029853 | A1 * | 10/2001 | Weishew | 101/216 |
| 2005/0085362 | A1 * | 4/2005 | Hutchinson et al. | 493/11 |

FOREIGN PATENT DOCUMENTS

| | | | |
|---|---|---|---|
| DE | 19600110 | A1 * | 7/1997 |
| FR | 2151309 | A | 4/1973 |
| FR | 2907712 | A | 5/2008 |
| GB | 2362854 | A | 12/2001 |

* cited by examiner

*Primary Examiner* — Matthew G Marini
*Assistant Examiner* — Allister Primo
(74) *Attorney, Agent, or Firm* — Davidson, Davidson & Kappel, LLC

(57) ABSTRACT

A method is provided for a rotary press of the type including at least one cylinder for printing and feeding a web to be printed, and a device for driving in rotation the or each printing and feed cylinder.

In normal operation, the at least one cylinder is driven by applying thereto a positive drive torque and a positive drive power, and, in the event of the web breaking, the at least one cylinder is braked by the associated drive device.

According to one embodiment of the invention, in an emergency shutdown step, the torque or the power applied to the at least one printing and feed cylinder by the associated drive device is limited in such a manner as not to exceed a predetermined torque threshold or power threshold.

24 Claims, 3 Drawing Sheets

METHOD FOR CONTROLLING A ROTARY PRESS AND ROTARY PRESS

This claims the benefit of French Patent Application No. 06 11319, filed on Dec. 22, 2006 and hereby incorporated by reference herein.

The present invention relates to a process for controlling a rotary press of the type comprising at least one printing unit having at least one cylinder for printing and feeding a web to be printed, and a device for driving in rotation the or each printing and feed cylinder.

BACKGROUND TO THE INVENTION

During printing operations, a web to be printed moves under tension and at high speed on the or each printing and feed cylinder.

The or each printing and feed cylinder is in contact with the web and is driven in rotation in such a manner that it contributes to the feeding of the web. The or each printing and feed cylinder also prints an image on the web by depositing ink thereon.

In the event of the web breaking downstream of a printing unit, the web loses its tension and tends to adhere to the or each printing and feed cylinder of the printing unit owing to the ink covering said cylinder. There is thus a risk that the web will become wound around a printing cylinder, which may very rapidly damage the printing cylinder, and more generally the printing unit, owing to an accumulation of layers of web between cylinders of the printing unit.

The replacement of a printing cylinder and the return of a printing unit to a working condition are extremely expensive operations.

SUMMARY OF THE INVENTION

An object of the invention provides limiting the risks of damage to the printing units in the event of the web breaking and to facilitate their return to a working condition.

To that end, the invention provides a process for controlling a rotary press, wherein, in normal operation, the or each printing and feed cylinder is driven by means of the associated drive device and, in the event of the web breaking, an emergency shutdown step is implemented by braking the or each printing and feed cylinder by means of the associated drive device, wherein, in the emergency shutdown step, the torque and/or power applied to the or each printing and feed cylinder by the associated drive device is (are) limited in such a manner as not to exceed a predetermined torque threshold and/or power threshold.

According to other embodiments, this process comprises one or more of the following features, taken in isolation or in accordance with any technically possible combination:

the torque and/or power is (are) limited to a torque threshold and/or power threshold, respectively, which is (are) lower than a nominal torque and/or nominal power, respectively, for driving the or each printing and feed cylinder during a normal operating step;

the torque threshold and/or the power threshold is (are) positive;

the device for driving the or each printing and feed cylinder is controlled in such a manner as not to exceed the torque threshold or power threshold, respectively, once the torque or power, respectively, has passed below a second predetermined torque threshold or power threshold, respectively, which is equal to or less than the first torque threshold or power threshold, respectively;

in normal operation, the device for driving the or each printing and feed cylinder is controlled in such a manner as to control the or each printing and feed cylinder in respect of angular velocity or angular position;

in the course of the emergency shutdown step, a negative braking torque and a negative braking power are applied to the or each printing and feed cylinder by means of the associated drive device.

The invention also provides a rotary press of the type comprising at least one printing unit having at least one printing group comprising a cylinder for printing and feeding a web to be printed, and a device for driving in rotation the or each printing and feed cylinder, and a system for controlling the drive device of the or each printing unit in order to apply to the or each printing and feed cylinder a positive torque and a positive power for driving in rotation or a negative torque and a negative power for braking, the control system being adapted and programmed for the implementation of a process such as defined above.

BRIEF DESCRIPTION OF THE DRAWINGS

The invention and its advantages will be better understood on reading the following description which is given purely by way of example and with reference to the appended drawings in which.

DESCRIPTION OF PREFERRED EMBODIMENTS

Figure 1:
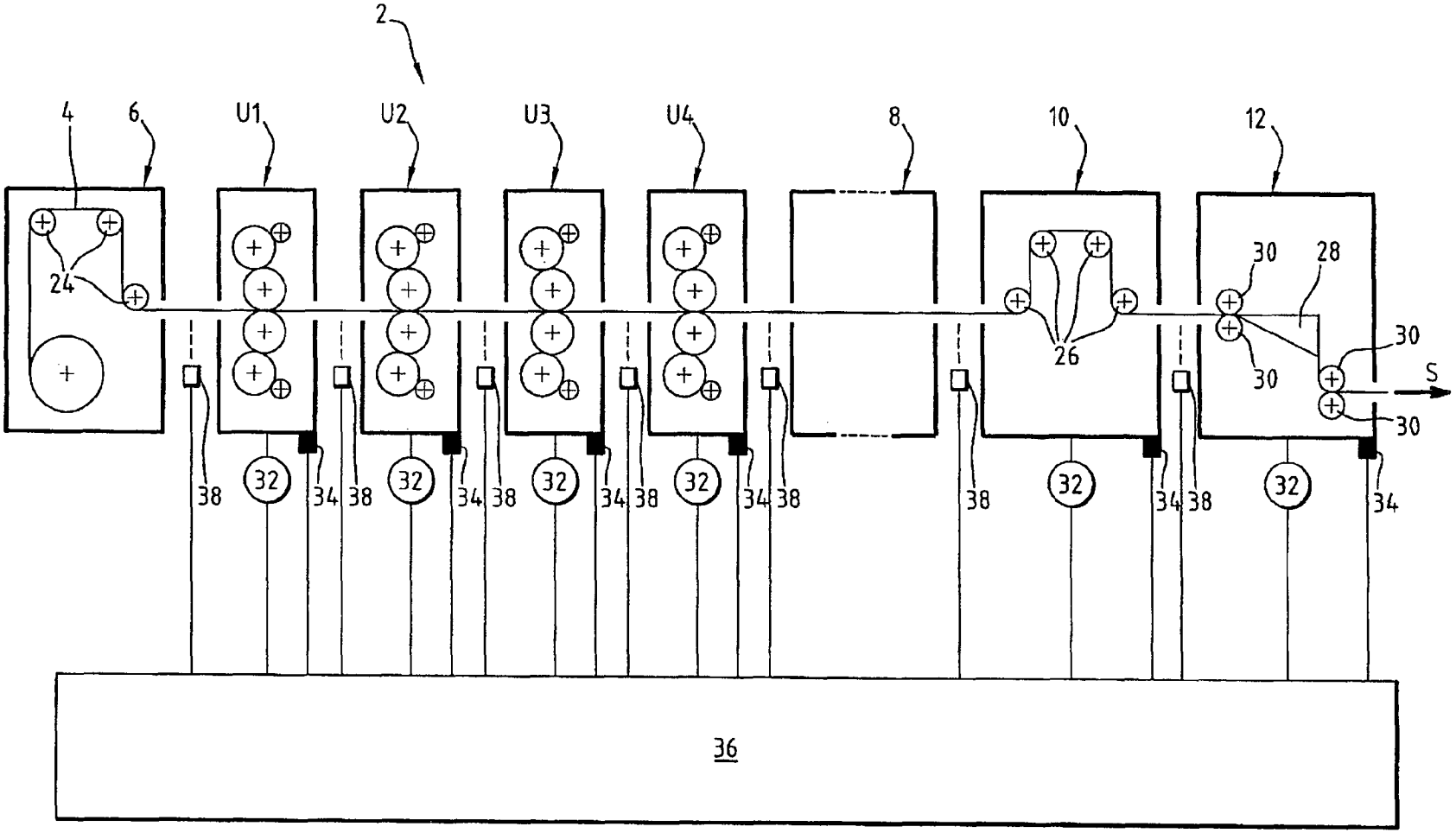
FIG. 1 is a general diagrammatic view of a rotary press according to the invention.

FIG. 1 illustrates a rotary press 2 for printing a web 4 of material, for example, a web of paper.

During printing operations, the web 4 moves through the press 2, under tension and at high speed, following a path of movement from left to right in FIG. 1, as illustrated by the arrow S.

In the following description, the terms "upstream" and "downstream" are to be understood in relation to the direction of movement of the web 4 in the press 2 following its path of movement.

The press 2 comprises a plurality of units for processing the web 4, including, in succession from upstream to downstream, an unreeling unit 6, printing units U1, U2, U3 and U4, a drying unit 8, a cooling unit 10 and a folding unit 12.

Units 8, 10 and 12 are optional.

The unreeling unit 6 enables the web 4 to be unwound from a roll. Each printing unit U1, U2, U3, U4 enables the web 4 to be printed recto-verso. The drying unit 8 enables the web 4 to be dried after it has been printed. The cooling unit 10 enables the web 4 to be cooled after it has been dried. The folding unit 12 enables the web 4 to be folded, for example, to form booklets.

Figure 2:
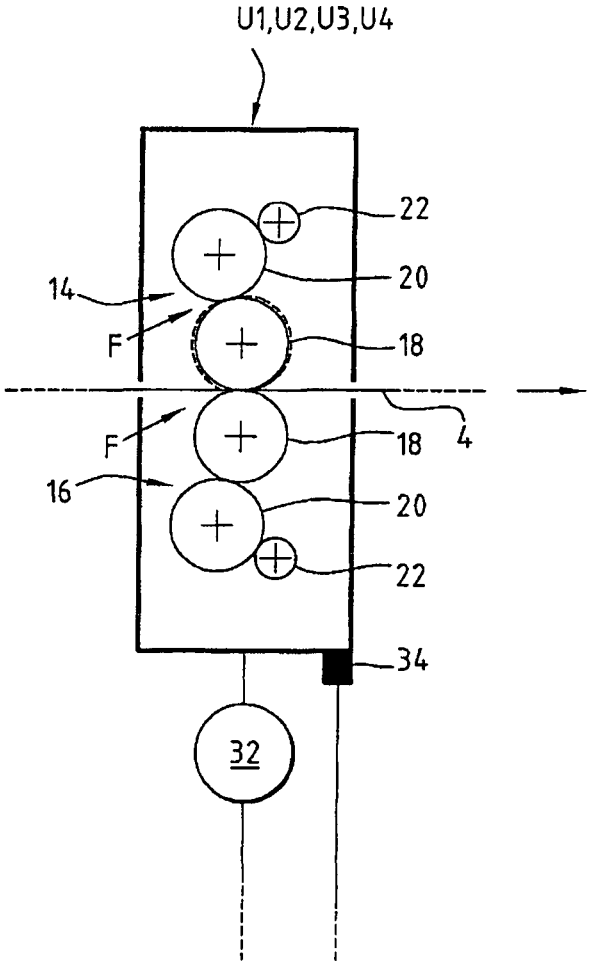
FIG. 2 is a diagrammatic view of a printing unit of the press of FIG. 1.

As shown in FIG. 2, each of the printing units U1, U2, U3, U4 is a twin unit and comprises two printing groups 14 and 16 located one on each side of the path of movement of the web 4 for recto-verso printing of the web 4.

Each printing group 14, 16 comprises a blanket printing cylinder 18, a plate cylinder 20 and an inking cylinder 22, which have parallel axes.

During printing operations, the cylinder 22 deposits ink on one or more plate(s) carried by the cylinder 20 and etched in accordance with the image to be printed, and the or each plate deposits the ink in accordance with the image on a blanket carried by the cylinder 18, which deposits the ink on one face of the web 4.

Each printing unit U1 comprises a mechanism for supporting and displacing the cylinders 18, 20, 22 of its printing groups 14 and 16 between a throw-on configuration (FIG. 2) and a throw-off configuration.

In throw-on configuration (FIG. 2), the cylinders 18 of the printing groups 14 and 16 have been moved close to each other and grip the web 4 between them.

In throw-off configuration, the cylinders 18 are spaced apart from each other by a spacing sufficient to allow the web 4 to pass through, that is to say, a spacing greater than the thickness of the web 4.

Returning to FIG. 1, the unreeling unit 6 has cylinders 24 for diverting the web 4, which are free in rotation.

The drying unit 8 comprises means for heating the web 4 in order to dry the ink deposited on the web 4.

The cooling unit 10 comprises cylinders 26 for diverting the web 4.

The folding unit 12 comprises a cone 28 for folding the web 4, for example, in accordance with a longitudinal folding line, and two pairs of cylinders 30 for feeding the web 4 which are located upstream and downstream of the folding cone 28. The two cylinders 30 of each pair grip the web 4 between them.

The units U1, U2, U3, U4, 10 and 12 have devices 32 for driving their cylinders 18, 26 and 30, each of those units having its own device 32.

Each device 32 comprises one or more motors. For example, in each of the printing units U1, U2, U3 and U4 the device 32 comprises a motor common to the two printing groups 14 and 16, one motor for each printing group 14 and 16, or one motor for each of the cylinders 18 and 20, and optionally 22.

The press 2 has a detecting device 34 associated with each of the units U1, U2, U3, U4, 10, 12, and a central control system 36.

Each detecting device 34 is suitable for emitting a measurement signal representing the angular position or the angular velocity of the cylinders 18, 26, 30 of the corresponding unit.

The control system 36 is connected to the detecting devices 34 in order to receive the measurement signals emitted therefrom and is connected to the drive devices 32 in order to send them control signals after processing the measurement signals.

During printing operations, the web 4 is fed through the press 2 by the cylinders 18, 26 and 30, which are driven in rotation by their associated device 32.

The rotation of the cylinders 18, 26 and 30 must be synchronized, on the one hand, in order to ensure the movement of the web 4 under tension between the various units of the press 2 and, on the other hand, to ensure correct printing of the web 4, without any shift between the printing effected by the various printing units U1, U2, U3, U4.

To that end, the control system 36 controls the cylinders 18, 26 and 30 in respect of angular position and/or angular velocity and ensures that they rotate in a synchronized manner.

It sometimes happens that the web 4 breaks during printing operations owing to the mechanical and thermal stresses to which it is subjected and often as a result of a defect in the web 4.

The press 2 has detectors 38 for web breakage which are located along the path of the web 4 and which are connected to the control system 36. The press 2 comprises, for example, one detector 38 between each pair of adjacent units.

The detectors 38 are detectors of a known type and, for example, optical detectors suitable for detecting a break in the web 4 by the modification of a light beam reflected by the web 4 or passing through the web 4 owing to the loss of tension in the web 4.

In the event of the web 4 breaking, there is a risk that any winding of the web 4 around the cylinders 18 of a printing unit U1, U2, U3, U4 will damage that printing unit and involve expensive operations of replacing the cylinders, the plates or the blankets, and of returning the printing unit to a working condition.

In order to protect the printing units U1, U2, U3 and U4 in the event of the web 4 breaking, an emergency shutdown step is implemented on the press 2, in the course of which the cylinders 18, 26, 30 are braked in a synchronized manner by applying to them a resistant braking torque by means of the drive devices 32, while at the same time displacing the printing groups 14, 16 into throw-off configuration in order to disengage the cylinders 18 from the web 4.

However, as illustrated by the broken line in FIG. 2, there is still a risk that the web 4 will, during the emergency shutdown, become wound around a cylinder 18 of a printing unit U1, U2, U3, U4 so that the web 4 is compressed between the cylinder 18, and the other cylinder 18 and/or the adjacent cylinder 20, at the sites marked by the arrows F.

The web 4 is unjammed, for example, unwound, for example, by causing the cylinders 18, 20 to rotate backwards.

Figure 3:
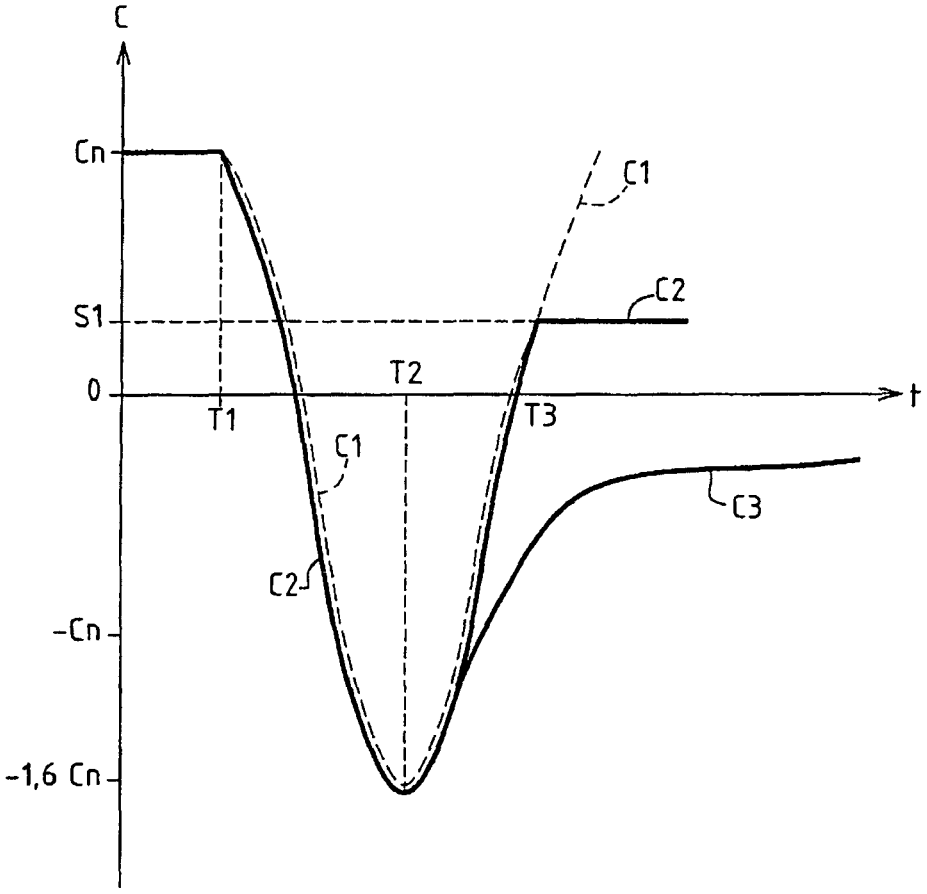
FIG. 3 is a graph representing the torque applied to a printing cylinder of the press of FIG. 1 over the course of time, in accordance with a control process according to the invention.

FIG. 3 is a graph illustrating the torque C (y-axis) applied by the device 32 of a printing unit, for example, the printing unit U1, to the cylinders 18 of that printing unit U1, as a function of time (x-axis), in the event of the web 4 breaking and becoming jammed in that printing unit U1.

By convention, a positive torque corresponds to a driving of the cylinder 18 in the direction of rotation of the cylinder 18 in normal operation.

The curve C1 with a broken line is a curve of a torque applied to a cylinder 18 of the unit U1, in accordance with a conventional control process.

In normal operation, up until an instant T1, the device 32 applies a positive nominal torque Cn for driving the cylinders 18 in rotation in order to compensate for the torques resistant to the feeding of the web 4.

As of the instant T1, at which a breakage of the web occurs, the control system 36 triggers the emergency shutdown step and controls the device 32 of the printing unit in such a manner as to apply to the cylinders 18 a negative braking torque, which may be as much as, for example, −1.6 Cn.

When the web 4 becomes jammed at an instant T2, it exerts a braking torque on the cylinders 18 of the printing unit U1. As a result, the braking torque applied by the device 32 decreases (the curve C1 rises again).

The braking torque exerted by the web 4 becomes so high that the cylinders 18 of the printing unit U1 brake more rapidly than those of the other printing units.

This is detected by the detecting devices 34 and the control system 36. Owing to the synchronized control in respect of the angular velocity and/or angular position of the cylinders 18 of the printing units U1, U2, U3, U4, the control system 36 causes the device 32 of the printing unit U1 to apply a positive drive torque (as of instant T3) to compensate for the negative braking torque of the web 4, so that the cylinders 18 of the printing unit U1 continue to rotate at the same rate as those of the other printing units.

In that case, the positive torque provided by the device 32 of the printing unit U1 contributes to jamming the web 4 even more.

This increases the risk of damaging the printing unit U1. It also makes it more difficult and time-consuming to re-start the printing unit U1. This re-starting may prove all the more difficult because the rotational inertia energy of the cylinder 18 at the moment when the web breaks will have contributed to the tightening of the web 4, while that energy will no longer be available to unjam the printing unit U1 by causing the cylinder 18 to rotate backwards by means of the device 32, and a motor of the device 32 will also have to overcome its starting torque in order to cause the cylinder 18 to rotate backwards.

In order to overcome that disadvantage, in accordance with the invention, in the press 2, the detecting devices 34 are suitable for providing a measurement signal representing the torque applied by each device 32 to the cylinders 18 of the associated printing unit U1, U2, U3, U4, and the control system 36 is suitable for taking those signals into account in order to control the devices 32 for driving the cylinders 18.

In accordance with the control process according to the invention, illustrated by the curve C2 with a solid line, in the emergency shutdown step the control system 36 controls the device 32 in such a manner as not to exceed a torque threshold S1 applied to the cylinders 18 of the printing unit U1.

The system 36 is therefore programmed to operate as a torque limiter during an emergency shutdown of the press 2.

Thus, in the event of the web 4 becoming jammed, in the printing unit U1, the torque will not exceed the threshold S1, which will limit the jamming of the web 4 and the risks of damaging the printing unit U1.

Preferably, the threshold S1 is lower than the nominal torque Cn because the application of a torque higher than the torque Cn during a braking step is the sign that the web 4 has become jammed.

Advantageously, the control system 36 prevents the threshold S1 from being exceeded again once the torque has passed below a second threshold S2.

The threshold S2 is preferably equal to or less than the threshold S1 in order not to interfere with the start of the step of synchronized braking of the press 2. The threshold S2 is, for example, equal to the threshold S1, or equal to a zero torque.

Preferably, the threshold S1 is positive. The torque resistant to the feeding of the web 4 is high in the printing units U1, U2, U3, U4 where the web 4 is gripped strongly by the cylinders 18. During emergency braking, it may be necessary to apply a slightly positive torque to the cylinders 18 so that they remain synchronized with the feed cylinders located downstream, but that does not mean that the web 4 will become jammed.

A curve C3 illustrates an example of a torque applied by the device 32 in the absence of the web becoming wound around a cylinder and jamming in the printing unit U1.

By way of variation or optionally, the system 36 controls the devices 32 of the printing units U1, U2, U3, U4 in such a manner as to limit the power P for driving the cylinders 18.

The driving power P applied by a device 32 to a cylinder 18 is proportional to the product of the torque applied by the device 32 and the rate of rotation of the cylinder 18.

Consequently, the power limitation is effected analogously to the torque limitation described above and has the same advantages.

The system 36 is therefore programmed to act as a power limiter at least in an emergency shutdown step. The system 36 uses the measurements of torque and rate of rotation provided by the detecting devices 34.

By convention, a positive power corresponds to a driving of the cylinder 18 in the direction of rotation of the cylinder 18 in normal operation.

What is claimed is:

1. A method for controlling a rotary press, the rotary press including at least one printing unit having at least one printing and feeding cylinder for a web to be printed, and an associated drive device for driving in rotation the at least one printing and feed cylinder, the method comprising the steps of:

driving, in normal operation, the at least one printing and feed cylinder using the associated drive device with a first torque or power;

performing, in the event of the web breaking, an emergency shutdown step by braking the at least one printing and feed cylinder using the associated drive device; and applying, in the emergency shutdown step, a second torque or power to the at least one printing and feed cylinder by the associated drive device, the second torque or power being limited so the second torque or power does not exceed a first predetermined torque threshold or power threshold.

2. The method as recited in claim 1 wherein the first predetermined torque threshold or power threshold is lower than the first torque or power, respectively, for driving the at least one printing and feed cylinder during a normal operating step.

3. The method as recited in claim 1 wherein the first predetermined torque threshold or the power threshold is positive.

4. The method as recited in claim 1 wherein the associated drive device for driving the at least one printing and feed cylinder is controlled so as not to exceed the first predetermined torque threshold or power threshold, respectively, once the second torque or power, respectively, has passed below a second predetermined torque threshold or power threshold, respectively, equal to or less than the first predetermined torque threshold or power threshold, respectively.

5. The method as recited in claim 1 wherein, in normal operation, the associated drive device for driving the at least one printing and feed cylinder is controlled so as to control the at least one printing and feed cylinder in respect of angular velocity or angular position.

6. The method as recited in claim 1 wherein in the emergency shutdown step, a negative braking torque and a negative braking power are applied to the at least one printing and feed cylinder by the associated drive device.

7. The method as recited in claim 1 wherein the printing and feed cylinder is a blanket cylinder.

8. The method as recited in claim 1 wherein the first torque is positive and the second torque is positive.

9. The method as recited in claim 4 wherein the second predetermined torque threshold is zero.

10. The method as recited in claim 6 further comprising the step of decreasing the negative braking torque and negative braking power applied to the at least one cylinder by the associated drive device.

11. The method for controlling a rotary press as recited in claim 1 wherein the step of braking occurs while the at least one printing cylinder is being displaced into a throw-off configuration.

12. The method as recited in claim 1 wherein an angular speed or angular position of the printing and feeding cylinder is synchronized with a further cylinder of a further printing unit in the rotary press and wherein a synchronized braking of the printing and feeding cylinder and the further cylinder occurs by limiting the second torque or power applied to the printing and feeding cylinder to the first predetermined torque threshold, the first predetermined torque threshold being less than the first torque or power.

13. The method as recited in claim 12 wherein, in the event of a web break, the second torque or power applied to the printing and feeding cylinder is compensating for a negative braking torque being applied to the printing and feeding cylinder by the broken web so the printing and feeding cylinder can continue to rotate at a same rate as the further cylinder.

14. A rotary press comprising at least one printing unit having at least one printing group including at least one printing and feeding cylinder for a web to be printed, a drive device for driving in rotation the or each printing and feed cylinder, and a controller controlling the drive device of the at least one printing unit to apply to the printing and feed cylinder a positive torque and a positive power for driving in rotation or a negative torque and a negative power for braking, the control system is adapted and programmed for driving, in normal operation, the at least one printing and feed cylinder using the associated drive device with a first torque or power and, performing, in the event of the web breaking, an emergency shutdown step by braking the at least one printing and feed cylinder using the associated drive device; and limiting, in the emergency shutdown step, a second torque or power driving the at least one printing and feed cylinder applied by the associated drive device, the second torque or power being limited so the at least one printing and feed cylinder does not exceed a first predetermined torque threshold or power threshold.

15. The rotary press as recited in claim 14 wherein the printing and feed cylinder is a blanket cylinder.

16. The rotary press as recited in claim 14 wherein the second torque is positive.

17. The rotary press as recited in claim 14 wherein the second torque or power is a positive torque or power, respectively, for driving in rotation.

18. The rotary press as recited in claim 14 further comprising:

a further printing unit having a further printing group including a further printing and feeding cylinder, the control system synchronizing the angular velocity or angular position of the at least one printing and feeding cylinder with the further printing and feeding cylinder, and in the event of a web break, the control system synchronizing a braking of the at least one printing and feeding cylinder and the further printing and feeding cylinder by limiting the second torque applied so the second torque does not exceed the first predetermined torque threshold, the first predetermined torque threshold being less than the first torque or power.

19. A method for controlling a rotary press, the rotary press including at least one printing cylinder for printing on a web and a corresponding drive device driving the at least one printing cylinder, the method comprising the steps of:

driving the at least one printing cylinder with the drive device by applying a first torque, the first torque being a positive driving torque;

braking the at least one printing cylinder, in an event of a web break, by applying a second torque, the second torque being a negative braking torque;

driving the at least one printing cylinder by applying a third torque, the third torque being a positive driving torque; and limiting the third torque to a first predetermined torque threshold to reduce damage to the at least one printing cylinder.

20. The method for controlling a rotary press as recited in claim 19, wherein the third torque is applied to synchronize the braking of the at least one printing cylinder with other printing cylinders in the rotary press.

21. The method for controlling a rotary press as recited in claim 19 wherein predetermined torque threshold is lower than the first torque.

22. The method for controlling a rotary press as recited in claim 19 further comprising a second predetermined torque threshold, the step of limiting the third torque to the predetermined torque threshold occurring when a torque of the drive device passes below the second predetermined torque threshold.

23. The method for controlling a rotary press as recited in claim 19 further comprising the step of detecting a rapid braking of the at least one printing cylinder with respect to other printing cylinders in the rotary press.

24. The method for controlling a rotary press as recited in claim 19 wherein the at least one printing cylinder is driven in a synchronized manner with respect to an angular position or angular velocity of other printing cylinders in the rotary press.

* * * * *